US005232094A

United States Patent [19]

Fagnant et al.

[11] Patent Number: 5,232,094

[45] Date of Patent: Aug. 3, 1993

[54] SHIPPING CONTAINER

[75] Inventors: Anthony G. Fagnant, Libertyville; Vincent J. Incandela, Chicago, both of Ill.

[73] Assignee: Label Makers, Inc., Franklin Park, Ill.

[21] Appl. No.: 901,683

[22] Filed: Jun. 22, 1992

[51] Int. Cl.[5] ..... B65D 85/00

[52] U.S. Cl. ..... 206/445; 220/4.21; 220/4.23; 229/2.5 R; 206/470; 206/471

[58] Field of Search ..... 206/445, 461, 463, 470, 206/471, 485; 229/2.5 R; 220/4.21, 4.22, 4.23, 4.24, 4.25

[56] References Cited

U.S. PATENT DOCUMENTS

| | | | |
|---|---|---|---|
| 581,232 | 4/1897 | Hollandt | 220/4.25 |
| 3,128,030 | 4/1964 | Davies | 229/2.5 |
| 3,131,846 | 5/1964 | Whiteford | 229/2.5 EC |
| 3,164,478 | 1/1965 | Bostrom | 206/445 |
| 3,322,267 | 5/1967 | Weiss | 229/2.5 |
| 3,326,443 | 6/1967 | Burkett | 229/2.5 |
| 3,333,760 | 8/1967 | Bridenstine | 229/2.5 |
| 3,342,397 | 9/1967 | Duitsman | 229/2.5 |
| 3,565,146 | 2/1971 | Arnolds | 220/4.24 |
| 3,580,463 | 5/1971 | Duerink | 229/2.5 |
| 3,591,032 | 6/1971 | Baxter | 229/2.5 |
| 3,740,238 | 6/1973 | Graham | 206/445 |
| 4,205,777 | 6/1980 | Brown et al. | 229/2.5 EC |
| 4,653,685 | 3/1987 | Leary et al. | 220/4.21 |
| 4,753,351 | 6/1988 | Guillin | 229/2.5 R |
| 4,795,033 | 1/1989 | Duffy | 220/4.21 |
| 4,796,756 | 1/1989 | Ott | 206/445 |
| 4,863,054 | 2/1989 | Capetta | 220/4.23 |
| 4,911,291 | 3/1990 | Iwata et al. | 206/445 |
| 5,048,684 | 9/1991 | Scott | 206/471 |
| 5,063,940 | 11/1991 | Adell et al. | 206/470 |

FOREIGN PATENT DOCUMENTS

| | | | |
|---|---|---|---|
| 1559692 | 6/1969 | France | 206/425 |
| 2923106 | 12/1980 | W. Germany | 206/461 |

OTHER PUBLICATIONS

Techform Inc., Packaging Brochure, Nov. 11, 1982

*Primary Examiner*—David T. Fidei

*Attorney, Agent, or Firm*—John P. Moran

[57] ABSTRACT

The drawings and description disclose a thin-walled, preferably transparent, stackable shipping container having upper and lower mating halves. The upper half includes a plurality of equally spaced, semicircular, laterally-extending compartments, and the bottom half includes a plurality of laterally-extending, substantially V-shaped compartments oppositely disposed from the semi-circular compartments. The two halves are held together by suitable integral fasteners.

7 Claims, 2 Drawing Sheets

SHIPPING CONTAINER

TECHNICAL FIELD

This invention relates generally to a shipping container and, more particularly, to a plastic container adaptable to carrying a plurality of stacks of flat lids having a lifting tab extending from one side thereof for use on small cups containing foodstuffs, such as yogurts, pudding, milk, and juices.

BACKGROUND ART

Heretofore, stacks of lids for small cups have conventionally been shipped in styrofoam containers having a plurality of parallel recesses formed therein. As such, the styrofoam containers have been used only once, and tended to shed small particles of styrofoam onto the stacks of lids. Due to the thickness of the styrofoam material required, the containers, while stackable for shipping, were not interdigitally stackable and, hence, encompassed considerable space.

Other known shipping containers include matching upper and lower halves with slots serving to contain individual items, such as computer chips, or the like.

DISCLOSURE OF THE INVENTION

A general object of the invention is to provide an improved shipping carton for lids for small cup-like containers, such as yogurt, puddings, milk, and fruit juice plastic cups.

Another object of the invention is to provide an improved shipping container formed of a thin plastic, such as PETG, PVC, or HIPS, material having a plurality of lateral upper and lower recesses conforming to the shape of lids for small cups.

A further object of the invention is to provide a thin-walled shipping container having upper and lower mating halves, wherein the upper half includes a plurality of equally spaced, semi-circular, laterally-extending compartments, and the bottom half includes a plurality of laterally-extending, substantially V-shaped compartments oppositely disposed from the semi-circular compartments.

Still another object of the invention is to provide such a shipping container which is formed of transparent resin material, such as polyester or polystyrene, in the range of 0.0025" to 0.060" thick.

A still further object of the invention is to provide such a shipping container which is re-usable.

Still another object of the invention is to provide such a shipping container which is lightweight and interdigitally stackable to conserve shipping weight and space.

A still further object of the invention is to provide such a shipping container which includes reinforcing ribs intermediate adjacent semi-circular compartments and intermediate adjacent V-shaped compartments.

These and other object and advantages of the invention will become more apparent when reference is made to the following drawings and the accompanying description.

BEST MODE OF CARRYING OUT THE INVENTION

Figures 1, 1A, 2, 3:
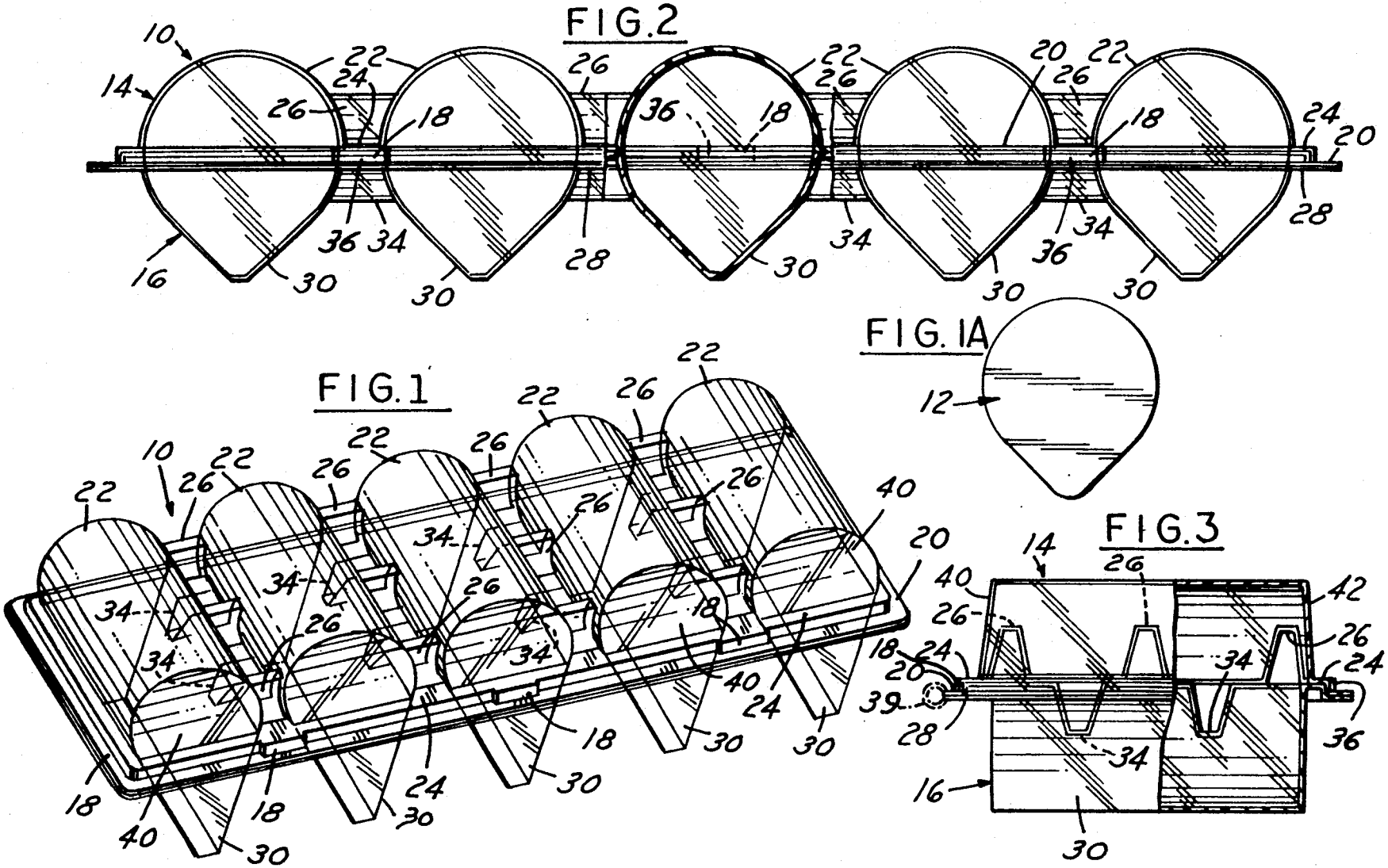
FIG. 1 is a perspective view of the inventive shipping container.
FIG. 1A is a plan view of a lid which is carried in stacks in the shipping container of FIG. 1.
FIG. 2 is a side elevational view in partial cross-section, taken along the plane of the line 2—2 of FIG. 1, and looking in the direction of the arrows.
FIG. 3 is an end view in partial cross-section, taken along the plane of the line 3—3 of FIG. 1, and looking in the direction of the arrows.

Referring now to the drawings in greater detail, FIG. 1 illustrates a shipping container 10, formed of a suitable plastic material, such as PETG, PVC, or HIPS, for shipping stacks of lids, represented at 12 (FIG. 1A), for small cups. The shipping container 10 includes an upper half 14 engageable with a lower half 16 by suitable integral fasteners, such as snap-type fasteners or flexible hinge fasteners 18, as will be explained.

The upper half 14 of the container 10 includes an outer, peripheral flange 20 having a stepped configuration, a plurality of, say, three to five, laterally extending, spaced apart, semi-circular projections 22 extending between oppositely disposed flange 20 sides forming compartments therebetween, with horizontal flat surfaces 24 of a predetermined width between adjacent semi-circular projections, and a plurality of, say, three, laterally spaced reinforcing ribs 26 formed in the flat surfaces 24 and extending between adjacent semi-circular projections 22.

The lower half 16 of the container 10 includes an outer peripheral flange 28 (FIG. 5) having a stepped configuration which meshes with the stepped configuration of the upper peripheral flange 20, a plurality of substantially V-shaped projections 30 directly opposite the respective semi-circular projections 22, forming compartments, with horizontal flat surfaces 32 formed between adjacent V-shaped projections and oppositely disposed from and abuttable against the flat surfaces 24, and reinforcing ribs 34 formed in each flat surface 32 and extending between adjacent V-shaped projections 30 so as to alternate vertically with the oppositely disposed reinforcing ribs 26.

The fasteners 18 each include a substantially rectangular projection 36 formed in one of the stepped flanges 20 or 28, while a rectangular indentation 38 is formed in the other of the flanges 20 or 28, such that each projection 36 snaps into and out of each adjacent indentation 38. At least one such fastener 18 is formed in each longitudinal side of each of the upper and lower halves 14 and 16, e.g., from one long to three short fasteners on each longitudinal side. Alternately, a flexible hinge, represented as 39 in FIG. 3, may be formed on one of the longitudinal sides, while one long or fewer short projections 36 and indentations 38 are formed along the other of the longitudinal sides.

Once the lower half 16 is filled with stacks of small lids 12, the upper half 14 is placed over same and the fasteners 18 snapped together. During shipping, the V-shaped projections 30 are seated on the reinforcing ribs 26, alternating back and forth to stack the containers 10 as high as desired.

Figures 4, 5:
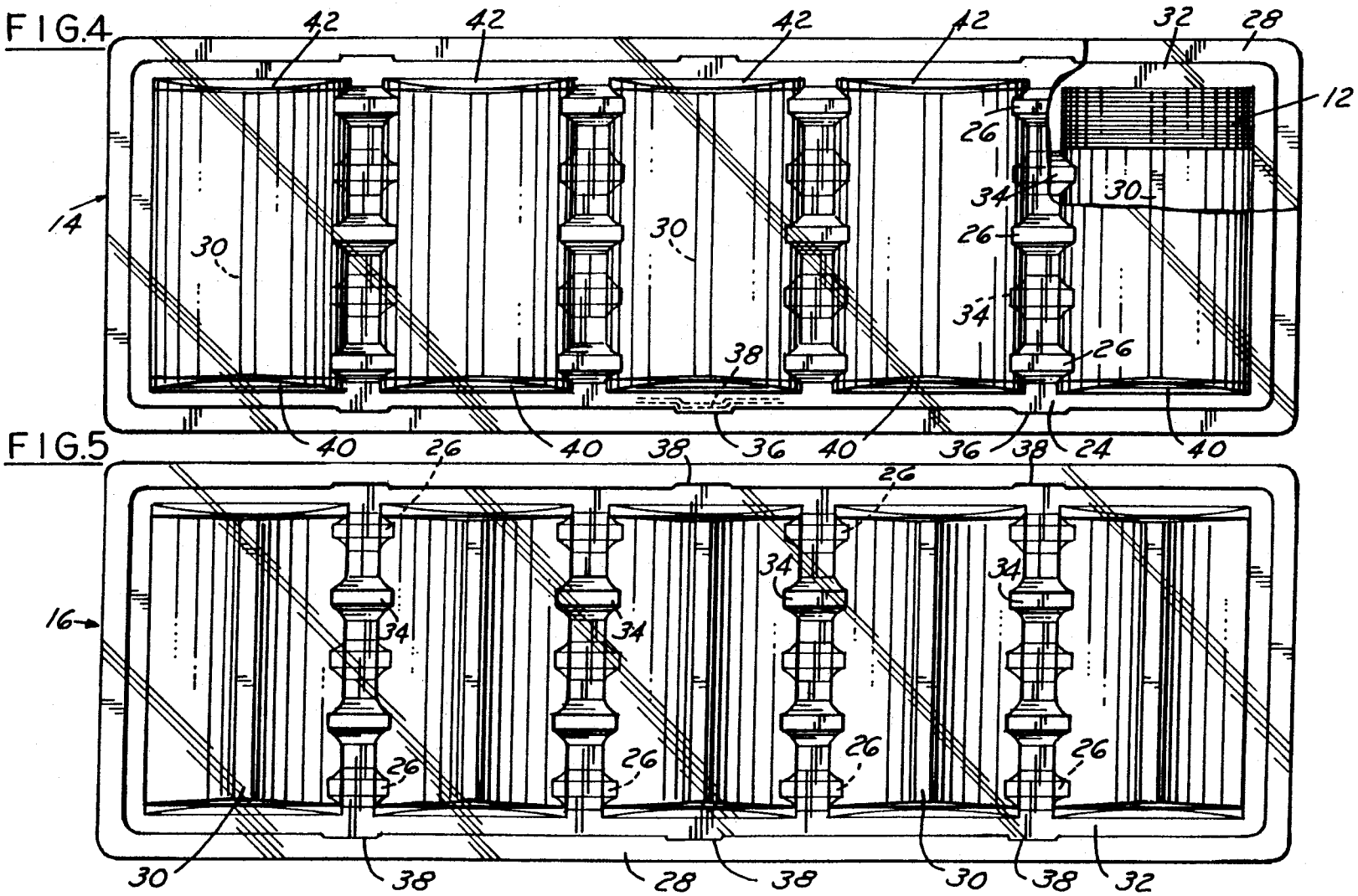
FIG. 4 is a top plan view of the FIG. 1 structure with a portion thereof broken away.
FIG. 5 is a bottom view of the Figure structure.

As best shown in FIGS. 3–5, the oppositely disposed ends 40 and 42 of each projection 22 is tapered to facilitate placing the upper half 14 over the loaded lids 12, onto the lower half.

INDUSTRIAL APPLICABILITY

It should be apparent that the invention provides sturdy, lightweight, interdigitably stackable shipping containers, which are reusable, preferably transparent, and adaptable to retain rows of foil lids for small cup-like containers, such as printed flat foil and other type material lids. Such lids are adaptable to being pressed onto the tops of the cup-like containers filled with selected foodstuffs, such as yogurt, puddings, and juices, such as orange juice.

It should be further apparent that each of the upper and lower sets of compartments could be formed as different shapes from those described above. For example, the contained lids could be square, or completely round, or a combination thereof.

While but one embodiment of the invention has been shown and described, other modifications are possible within the scope of the following claims.

What is claimed is:

1. A carrier for lids for small cartons, said shipping container comprising an upper half and a lower half, said upper half including a plurality of spaced laterally extending semi-circular projections and a first peripheral edge therearound, said lower half including a plurality of laterally extending substantially V-shaped projections directly oppositely disposed from respective semi-circular projections and a second peripheral edge therearound for abutting against said first peripheral edge, each oppositely disposed semi-circular and V-shaped projections adapted to receive a predetermined stack of lids, integral fastener means formed on said first and second peripheral edges for releasably securing said upper and lower halves together, and alternately oppositely disposed first and second reinforcing ribs and planar segments formed between said respective oppositely disposed semi-circular and V-shaped projections.

2. The carrier described in claim 1 wherein said first and second peripheral edges are each formed in a stepped configuration and adaptable to mesh with one another.

3. The carrier described in claim 2, wherein said integral fastener means includes at least one substantially rectangular projection formed on one of said first and second peripheral edges, and at least one indentation formed on the other of said first and second peripheral edges adaptable to releasably interconnect with said rectangular projections when pressed together.

4. The carrier described in claim 3, and a flexible hinge formed between opposite edges of one side of each half.

5. The carrier described in claim 1 wherein said upper and lower container halves are formed of thin transparent resin material.

6. The carrier described in claim 5 wherein said resin material is in the range of 0.025" to 0.060" inch thick.

7. The carrier described in claim 5, wherein said resin material is one of the group including polyester, polystyrene, PETG, PVC, and HIPS.

* * * * *